United States Patent [19]

Underwood

[11] 4,147,084

[45] Apr. 3, 1979

[54] SOUND PICK-UP ATTACHMENT FOR STRINGED INSTRUMENT

[76] Inventor: Donald E. Underwood, W. Garzas Rd., Carmel Valley, Calif. 93924

[21] Appl. No.: 811,602

[22] Filed: Jun. 30, 1977

[51] Int. Cl.[2] ..... G10H 3/02

[52] U.S. Cl. ..... 84/1.16; 84/DIG. 24

[58] Field of Search ..... 84/1.04, 1.14–1.16, 84/DIG. 24

[56] References Cited

U.S. PATENT DOCUMENTS

| | | | |
|---|---|---|---|
| 2,725,778 | 12/1955 | Cronwell | 84/1.16 |
| 3,325,580 | 6/1967 | Barcus et al. | 84/1.16 |
| 4,030,396 | 6/1977 | Mariner | 84/1.16 |

*Primary Examiner*—Stanley J. Witkowski
*Attorney, Agent, or Firm*—Jack M. Wiseman

[57] ABSTRACT

A plurality of sound pick-up devices are mounted between the legs and wings of a bridge for a bass viol. Each sound pick-up device comprises a brass housing in which is disposed a transducer disc. Contiguous with one side of the transducer disc is a brass shim contact. A foam damper pad is disposed between the shim contact and the housing. The housing is in the form of spaced members joined at one side and a silicon latex potting material fills the spaces remaining between the spaced members. A coaxial cable interconnects the pick-up devices and is of sufficient length to permit the mounting of the pick-up devices in the side cut-out slots between the crown wings and the legs on each side of the bridge. The coaxial cable terminates on a cable connector for connection to an amplifier through a suitable output cable.

13 Claims, 8 Drawing Figures

Fig-4
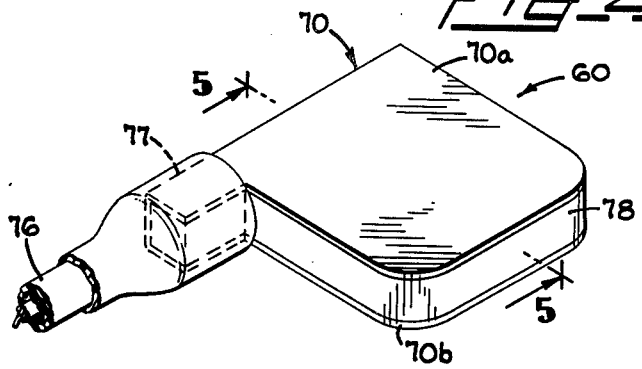
Fig-5
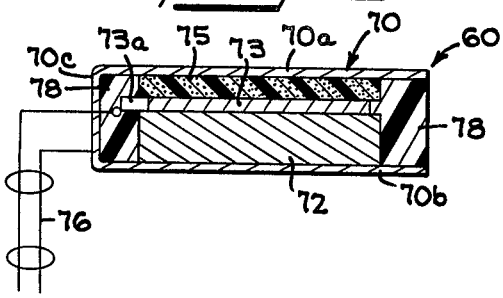
Fig-6
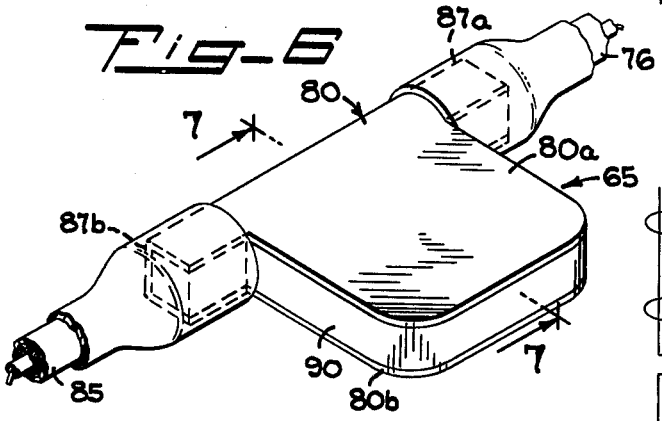
Fig-7
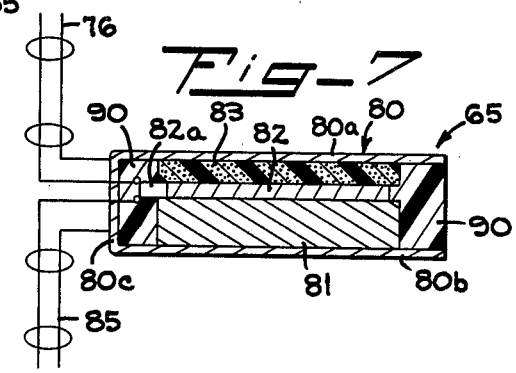
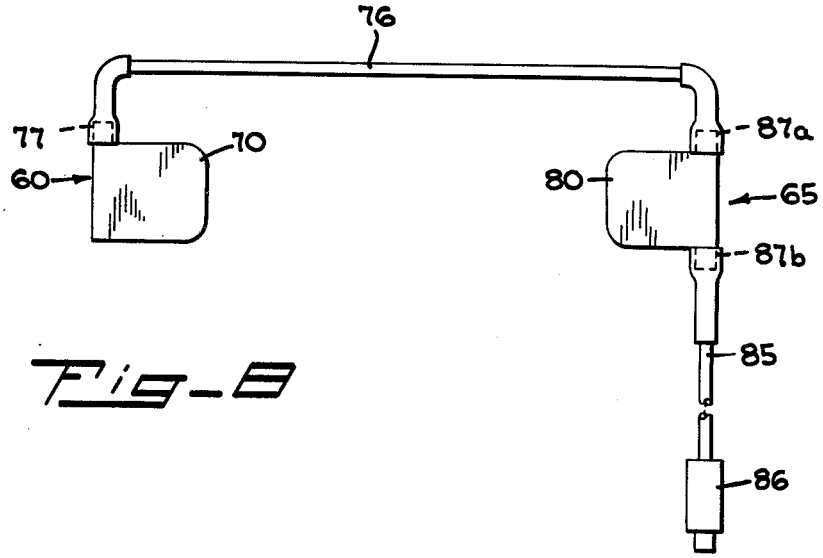
Fig-8

SOUND PICK-UP ATTACHMENT FOR STRINGED INSTRUMENT

BACKGROUND OF THE INVENTION

The present invention relates in general to sound pick-up devices, and more particularly to a sound pick-up device mounted on a stringed musical instrument for electronic sound amplification.

While reference herein is made to a bass viol, double bass viol, upright string bass and other musical instruments of the violin family, it is to be understood that the present invention has application in any stringed instrument employing a bridge on which musical strings are disposed.

The double bass viol produces the principal bass sound for many different musical groups. However, such instruments have been known to have inadequate amplitude. Hence, it is common for large orchestras to have as many as eight bassists for tonal balance in the group. Smaller musical groups, such as dance orchestras and jazz combos, use the bass viol for rhythm as well as bass sound. Without electronic sound amplification, the bass sound is often inadequate to be heard in a group. Hence, bassists often employ electronic sound amplification to develop a sufficient bass sound. The devices heretofore employed for sound pick-up in sound amplification systems sacrificed tone quality and character.

Sound pick-up devices heretofore employed in sound amplification systems for musical instruments were the air coupled microphone, the soundboard contact microphone, the electromagnetic string motion detector and the piezo transducer. The air coupled microphone has frequently been placed in the general vicinity of the sound board or sound holes of the instrument. Such arrangements employed very high quality microphones, with the result that sounds in addition to the musical instrument were detected. The soundboard contact microphone frequently used either a crystal or electromagnetic disc type detector that was attached directly to the soundboard of the instrument. There are various small areas of the soundboard of the bass viol of limited size that emit only part of the overall tone of the instrument, which results in inadequate tone quality and character. There were also tendencies to dampen the natural movement of the soundboard and modify the natural tones of the instrument.

The electromagnetic string motion detector required the use of ferrous strings. The detector was generally mounted under the strings at the lower end of the fingerboard. It sometimes included adjustable individual pole pieces designed to detect the lateral motions of the individual strings. Since the strings were set into various nodal patterns as the musician selected various pitch lengths, there was no single location along the sounding length of the instrument that could be considered ideal for detecting all of the harmonics of the strings.

The piezo-electric transducer detectors were of two basic types. One type was secured by wax or cement to the surface of the bridge. Such an arrangement picked up sound waves travelling in the bridge. Thus, the devices of such an arrangement detected sound waves in a limited area and had inadequate tone quality and character. Additionally, such devices were produced with great sensitivity, which resulted in feed back oscillations when too close to the amplifier. The other type was known as the wedge type transducer device. It was wedged or mounted between the legs of the bridge. The wedge type transducer device employed a cylindrical case made up of a piston and cylinder. A ceramic piezo transducer was disposed in the cylinder to be subject to compressions. A threaded screw was provided for adjustment of the compressive force. A silicon latex seal in the cylinder surrounded the piston. The cylinder and piston were of high mass and had a pointed, conical surface. The high mass, restrictive seal and high frequency deflecting cone shaped mounting points had the tendency to limit frequency response. As a consequence thereof, the tone quality was less than desired. Constant tightening was required to reduce rattling. Feed back oscillations were also problem.

SUMMARY OF THE INVENTION

A sound pick-up device mounted between the leg and the wing of a bridge for a stringed instrument for the electronic sound amplification of the sound produced by the stringed instrument.

By virtue of the present invention, a electronic sound amplification for the sounds produced by a stringed instrument is provided with improved tonal quality and character.

DESCRIPTION OF THE DRAWINGS

FIG. 4 is a perspective view of a sound pick-up device employed in the present invention.

FIG. 5 is a partially diagrammatic, enlarged vertical section view of the sound pick-up device taken along line 5—5 of FIG. 4.

FIG. 6 is a perspective view of another sound pick-up device employed in the present invention.

FIG. 7 is a partially diagrammatic, enlarged vertical section view of the other sound pick-up device taken along line 7—7 of FIG. 6.

FIG. 8 is a diagrammatic illustration of the sound pick-up devices shown in FIGS. 4–7 interconnected for connection to a connector for an electronic sound amplification system.

DESCRIPTION OF THE PREFERRED EMBODIMENT

Figure 1:
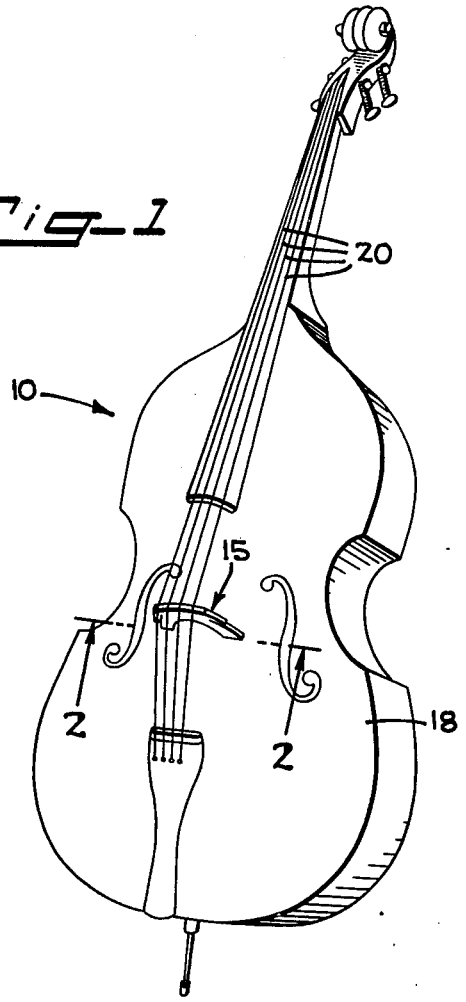
FIG. 1 is a perspective view of a typical bass viol.

Illustrated in FIG. 1 is a typical bass viol 10 adaptable for use in the present invention. Mounted on the bass viol 10 is a well-known bridge 15. Additionally, the typical bass viol includes a bass bar 16 (FIGS. 2 and 3), a sound post 17, a sounding board 18 and four strings 20.

Figure 2:
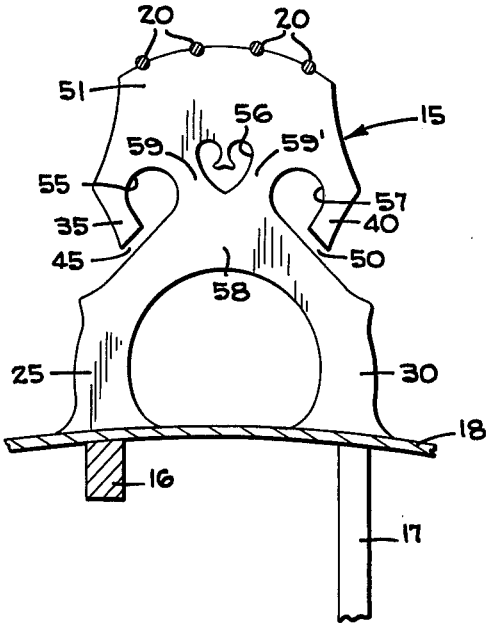
FIG. 2 is an elevation view of a bridge employed in the bass viol shown in FIG. 1 as viewed along line 2—2 of FIG. 1.
Figure 3:
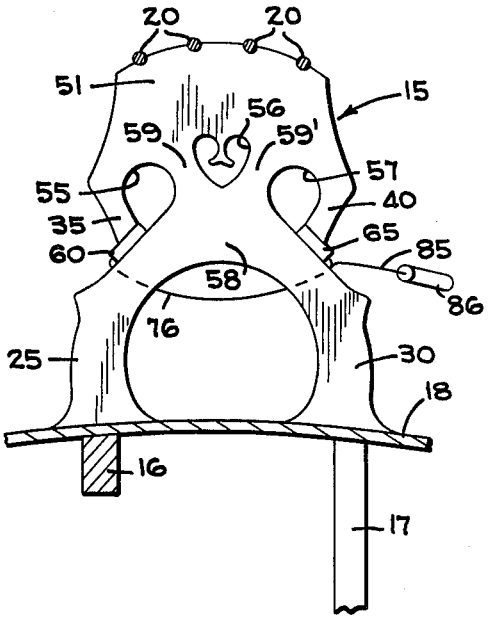
FIG. 3 is an elevation view of the bridge employed in the bass viol shown in FIG. 1 with the sound pick-up devices mounted between the leg and the wing of the bridge in accordance with the present invention as viewed along line 2—2 of FIG. 1.

The conventional bridge 15 is made of wood and comprises a pair of legs 25 and 30 (FIGS. 2 and 3). Confronting the legs 25 and 30 are a pair of wings 35 and 40 of the bridge 15, which define spaces 45 and 50 with the legs 25 and 30, respectively. The strings 20 are disposed on a crown 51 of the bridge 15. As is well-known in the art, the sound post 17 serves to support the trebel side of the sound board 18 against the forces applied through the strings 20. In a similar manner, the bass bar 16 serves to support the bass side of the sound board 18 against the forces applied through the strings 20. The bass bar 16 has greater yieldability than does the sound post 17 and is more responsive to vibrating motions for the transmission of vibrations to the sound board 18.

It has been known that the leg 25 of the bridge 15, which is adjacent to the bass bar 16, engages an area that is more yieldable to vibratory motions than the leg 30 of the bridge 15, which is adjacent to the sound post 17. Stated otherwise, the leg 30 stands on a fulcrum and leg 25 stands on a more yieldable area. Thus, any sidewise force applied to the crown 51 of the bridge 15 should result in the application of pivotal force to the bridge 15 for urging the bridge 15 to pivot about the fulcrum at the sound post 17. As a consequence thereof, there is an increasing or decreasing movement applied at the bass bar 16 side of the sound post 17. Since there are scroll cuts 55, 56 and 57 formed in the bridge 15, it appears that a second set of vibratory motions will be present.

The bridge 15 is formed with an arch 58 at the end thereof defining the legs 25 and 30. Two short pillars 59 and 59′ join the arch 58 to the crown 51. The wood grains of the bridge 15 run transversely thereacross rendering the pillars 59 and 59′ semiflexible. Thus, the pillars 59 and 59′ are in the nature of short, stiff springs under balanced compression from the strings 20.

The conventional strings 20 are held in tension in the notches across the crown 51 of the bridge 15. The strings 20 apply a downward force to the ridge 15, resulting in the application of a downward force on the sounding board 18. As a string 20 is plucked or bowed to set up a vibratory motion, oscillations are formed on a plane generally parallel to the sounding board 18. The resulting side forces presented by the oscillations are urged upon the crown 51. As a consequence thereof, the crown 51 is displaced laterally in response to the vibratory motions of the oscillations.

The lateral displacement of the crown 51, in turn, applies compression forces on the pillars 59 and 59′ of the bridge 15, which are vibratory motions of the oscillations. The vibratory motions applied to either pillar 59 or 59′ of the bridge 15 will result in a downward force near the center of the arch 58 of the bridge 15 adjacent to the sounding board 18. One complete oscillation of a string 20 results in two downward thrusts on the arch 58. Since one side of the arch 58 rests on a fulcrum, the bass bar 16 end of the arch 58 moves in response to each thrust. This action results in a doubling of the string frequency at the sounding board 18. The sounding board 18 functions as a resonator for the base viol 10. Thus, there is created a motion amplification and frequency doubling that influences the harmonic content of the tone of the bass viol 10.

The effect of the above-described action is an improved tone quality for the bass viol 10. There is a pronounced octave harmonic and the overall harmonic development is strong beginning with the octave. The fundamental frequency is present, but it is often weaker than the octave. The resulting tone has clarity and pitch definition. The above observations apply to all members of the violin family.

According to the present invention, sound pick-up devices 60 and 65 (FIG. 3) are disposed in the openings 45 and 50, respectively, of the bridge 15. Stated otherwise, the sound pick-up device 60 is mounted between the leg 25 and the wing 35 of the bridge 15, and the sound pick-up device 65 is mounted between the leg 30 and the wing 40 of the bridge 15. In this manner, the present invention implements the articulated action of the bridge 15, as above described, for use in an electronic sound amplification system.

The mounting of the pick-up devices 60 and 65 between the legs 25 and 30 and the wings 35 and 40 of the bridge 15 enables the detection of the normally conducted sound waves and the synthesized harmonic produced by the bass viol 10. Thus, the tone quality of the bass viol 10 is faithfully detected.

The sound pick-up device 60 (FIGS. 4–8) comprises a suitable housing 70 made of brass. In the exemplary embodiment, the housing 70 is 5/32″ thick, ⅝″ wide and ¾″ long. The housing 70 includes spaced, parallel members 70*a* and 70*b*, and an interconnecting end member 70*c*. Disposed within the housing 70 is a ceramic piezo transducer 72, which may be of the type manufactured and sold by Linden Laboratories, 700–900 pf. Engaging the transducer 72 within the housing 70 is a shim contact 73, which, in the preferred embodiment, is made of brass, and provides a positive polarity contact. Disposed between the shim contact 73 and the housing 70 is a damper pad 75 made of suitable material, such as foam. A coaxial cable 76 is electrically connected to a tab 73*a* of the shim contact 73 and to the end member 70*c* of the housing 70. A strain relief clamp 77 is integrally formed with the members 70*a*–70*c* to project outwardly therefrom. The end of the coaxial cable 76 is fixed to the strain relief clamp 77 by a suitable latex seal. A suitable latex seal 78 also fills all the remaining spaces within the housing 70 to provide a compact, sturdy, unitary sound pick-up device.

The sound pick-up device 65 comprises a suitable housing 80 made of brass. In the exemplary embodiment, the housing 80 is 5/32″ thick, ⅝″ wide and ¾″ long. The housing 80 includes spaced, parallel members 80*a* and 80*b* and an interconnecting end member 80*c*. Disposed within the housing 80 is a ceramic piezo transducer 81, which may be of the type manufactured and sold by Linden Laboratories, 700–900 pf. Engaging the transducer 81 within the housing 80 is a shim contact 82, which, in the preferred embodiment, is made of brass, and provides positive polarity contact. Disposed between the shim contact 82 and housing 80 is a damper pad 83 made of suitable material, such as foam. The coaxial cable 76 is electrically connected to a tab 82*a* of the shim contact 82 and to the member 80*c* of the housing 80. A coaxial output cable 85 is also electrically connected to the tab 82*a* of the shim contact 82 and to the end member 80*c* of the housing 80. The free end of the coaxial output cable 85 is connected to a conventional phono jack 86 for establishing a connection with an electronic sound amplification system, not shown. Strain relief clamps 87*a* and 87*b* are integrally formed with the members 70*a*–70*c* on opposite sides of the housing 80 to project outwardly therefrom in an oppositely directed manner. The end of the coaxial cable 76 is fixed to strain relief clamp 87*a* by a suitable latex seal. Similarly, the end of the coaxial cable 85 is fixed to the strain relief 87*b* by a suitable latex seal. A suitable latex seal 90 also fills all the remaining spaces within the housing 80 to provide a compact, sturdy, unitary sound pick-up device.

I claim:

1. In combination:

a stringed instrument comprising:

(a) a sounding board to provide a resonator; and (b) a bridge comprising a first leg projecting from said sounding board and a first wing confronting said first leg in spaced relation for producing vibrating motions; and (c) a first sound pick-up device disposed between said first leg and said first wing to detect the vibratory motions produced therefrom.

2. A combination as claimed in claim 1 wherein:

said bridge further comprises a second leg projecting from said sounding board and a second wing confronting said second leg in spaced relation for producing vibratory motions; and a second sound pick-up device disposed between said second leg and said second wing to detect the vibratory motions produced therefrom.

3. A combination as claimed in claim 2 and further comprising:

a jack; and means interconnecting said jack and said first and second pick-up devices for establishing electrical connections therebetween.

4. A combination as claimed in claim 1 wherein said first sound pick-up device comprises a housing, said housing being formed with confronting walls reacting to vibratory motions produced by said first leg and said first wing; a transducer disposed in said housing; an electrical contact member disposed in engagement with said transducer; and a compressible damping pad disposed in said housing between said housing and said transducer, said transducer being responsive to the reaction of said confronting walls to said vibratory motions for producing electrical signals.

5. A combination as claimed in claim 4 and comprising a jack; and means interconnecting said jack and said contact member for establishing electrical connections from said contact member to said jack.

6. A combination as claimed in claim 2 wherein said first and second pick-up devices respectively comprise a housing, said housing being formed with confronting walls reacting to vibratory motions produced by its associated leg and wing; a transducer disposed in said housing; an electrical contact member disposed in engagement with said transducer; and a compressible damping pad disposed in said housing between said housing and said transducer, said transducer being responsive to the reaction of the confronting walls of its associated housing to vibratory motions for producing electrical signals.

7. A combination as claimed in claim 6 and comprising a jack; and means interconnecting said jack and said contact member for establishing electrical connections from said contact member to said jack.

8. A combination as claimed in claim 4 and comprising seal means for filling said housing.

9. A combination as claimed in claim 7 and comprising seal means for filling said housing.

10. A combination as claimed in claim 8 wherein said confronting walls are in the form of spaced, parallel members, and said housing includes a member interconnecting confronting ends of said spaced members.

11. A combination as claimed in claim 9 wherein the confronting walls of each of said housings is in the form of spaced, parallel members, and each of said housings includes a member interconnecting confronting ends of the associated spaced members.

12. A combination as claimed in claim 4 wherein said transducer includes oppositely directed flat walls, said contact member being flat and extending along one of the flat walls of said transducer, the other flat wall of said transducer being in engagement with one of said confronting walls of said housing, and said damping pad being contiguous with the other of the flat walls of said contact member and the other confronting wall of said housing.

13. A combination as claimed in claim 6 wherein each of said transducers includes oppositely directed flat walls, the associated contact member being flat and extending along one of the flat walls of the associated transducer, the other flat wall of each of said transducers being in engagement with one of the confronting walls of its associated housing, and each of the damping pads being contiguous with the other of the flat walls of its associated contact member and the other of the confronting walls of its associated housing.

* * * * *